US005848667A

United States Patent [19]

Davidson

[11] Patent Number: 5,848,667

[45] Date of Patent: Dec. 15, 1998

[54] FLEXIBLE AND FOLDABLE MARINE LADDER

[76] Inventor: Robert Davidson, 58 S. Gate La., Southport, Conn. 06490

[21] Appl. No.: 799,703

[22] Filed: Feb. 11, 1997

[51] Int. Cl.[6] ..... B63B 17/00

[52] U.S. Cl. ..... 182/190; 182/90; 182/93; 182/196

[58] Field of Search ..... 182/190, 100, 182/189, 196, 93, 70, 90; 114/362

[56] References Cited

U.S. PATENT DOCUMENTS

| | | | |
|---|---|---|---|
| 2,975,859 | 3/1961 | Billingsley | 114/362 |
| 3,817,351 | 6/1974 | Mikkelson | 182/189 |
| 3,923,171 | 12/1975 | Ragnell | 182/190 |
| 5,540,178 | 7/1996 | Damron | 182/196 X |

*Primary Examiner*—Alvin C. Chin-Shue

*Attorney, Agent, or Firm*—James V. Harmon

[57] ABSTRACT

A folding ladder includes a vertical supporting strap formed from fabric material. The supporting strap has top and bottom ends. The top end of the strap has means, e.g., a fastener, rope or opening, for securing it to a fixed object for holding the ladder upright. At least one loop formed from strap material is provided below the top of the strap and is held in place by the supporting strap. The strap loop depends from the supporting strap and has two upper portions that are connected to each other at the top of the loop. The connected upper portions of the loop lie in lapped face-to-face relationship. Each such loop includes a downwardly depending, generally U-shaped intermediate bend between the connected portions. The U-shaped bend defines a step or hand grip with an opening above it to facilitate the entry of a hand or foot. In a preferred form of the invention, the strap material of each loop is provided with one or more half-twists.

7 Claims, 2 Drawing Sheets

FLEXIBLE AND FOLDABLE MARINE LADDER

FIELD OF THE INVENTION

This invention relates to ladders and more particularly to ladders that can be folded for storage and are suited for use as boarding ladders for boats.

BACKGROUND OF THE INVENTION

A variety of folding ladders have been previously proposed. Rigid parts, however, interfere with the collapsibility of the ladder and increase its size, bulk and weight. Moreover, ladders that contain metal parts are subject to rust or corrosion, especially in marine use. During the development of the present invention, an attempt was made to develop a ladder formed entirely from fibrous material such a cloth, cordage or the like that was suitable as a compact folding ladder for boarding a boat from the water. A boarding ladder facilitates climbing aboard a boat after swimming, diving or after falling overboard. While a variety of collapsible boarding ladders have been available for marine use, few if any commercially successful ladders are formed entirely from flexible fibrous material.

One important object of the present invention is to find a way to construct a boarding ladder formed entirely from flexible material. In perfecting the present invention, different flexible materials were tried, but in early prototypes it was found difficult to easily gain a hand- or foothold. It was discovered that fabric has a tendency to sag so that the openings that hands and feet are intended to enter close upon themselves, making it difficult for a hand or foot to enter the intended opening in the ladder above each rung.

One object of the present invention is to provide a folding ladder constructed entirely or almost entirely from flexible or foldable material, i.e., with no need for a rigid material below each step.

Another object is to provide a ladder formed entirely from flexible material which does not cause discomfort for the hands or feet.

A more specific object is to provide a folding ladder that can be used for boarding a boat from the water and, while fully foldable and flexible, still allows a person to easily place a hand or foot in the intended opening by providing a means for assuring that the opening above each rung or step of the ladder will remain sufficiently open to enable a hand or foot to enter easily.

Yet another object is to provide a compact storage system which facilitates emergency deployment of the ladder.

It is a further object to provide a folding ladder that can be folded into a compact bundle for storage, yet is low in cost, weatherproof, rugged in construction and reliable in operation.

These and other more detailed and specific objects of the present invention will be better understood by reference to the following figures and detailed description which illustrate by way of example but a few of the various forms of the invention within the scope of the appended claims.

SUMMARY OF THE INVENTION

The invention provides a folding ladder having a vertical supporting strap formed from fabric material. The supporting strap has top and bottom ends. The top end of the strap has means, e.g., a fastener, rope or opening, for securing it to a fixed object for holding the ladder upright. At least one loop formed from strap material is provided below the top of the strap and is held in place by the supporting strap. The strap loop depends from the supporting strap and has two upper portions that are connected to each other at the top of the loop. The connected upper portions of the loop lie in lapped face-to-face relationship. Each such loop includes a downwardly depending, generally U-shaped intermediate bend between the connected portions. The U-shaped bend defines a step or hand grip with an opening above it to facilitate the entry of a hand or foot. In a preferred form of the invention, the strap material of each loop is provided with one or more half-twists. When a single half-twist is used, opposite surfaces of the strap are connected together in face-to-face relationship rather than the same surface of the strap being in contact with itself as is the case with a loop having no twist. The invention provides an excellent emergency boarding ladder for sailboats, runabouts, dinghies, yachts and other boats.

THE FIGURES

DETAILED DESCRIPTION OF THE INVENTION

Figure 1:
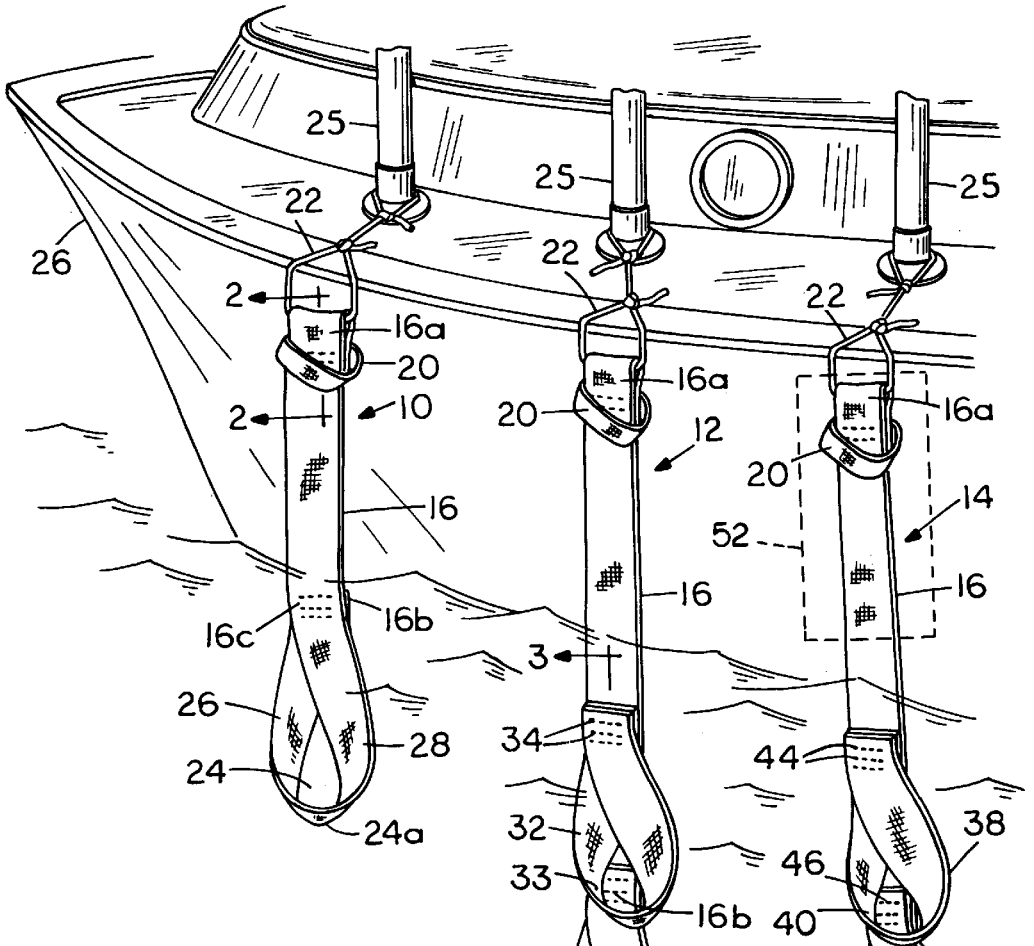
FIG. 1 is a perspective view of the invention shown by way of example in three different sizes deployed for use from the side of a boat.
Figure 2:
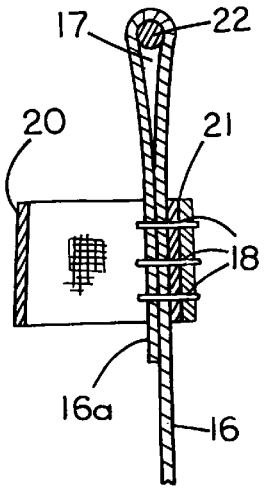
FIG. 2 is a vertical sectional view taken on line 2—2 of FIG. 1 on an enlarged scale.
Figure 3:
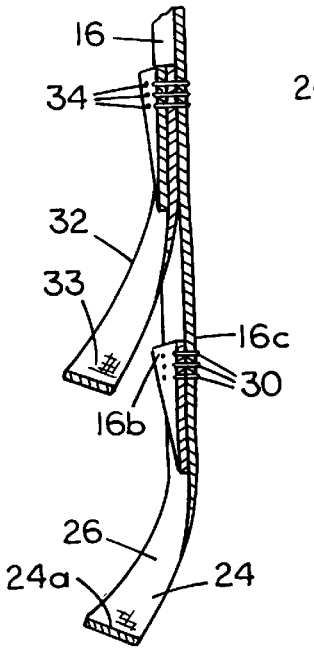
FIG. 3 is a vertical sectional view taken on line 3—3 of FIG. 1 on an enlarged scale.

Refer now to FIGS. 1–3 which illustrate the invention by way of example in use as a boarding ladder for a boat.

The invention illustrated in FIG. 1 comprises a folding ladder, shown in three different sizes designated 10, 12 and 14 wherein the same numerals refer to corresponding parts. While three sizes are shown, any number of steps can be provided. Each of the ladders 10–14 includes a vertical supporting strap 16 which has a top end 16*a* and a bottom end 16*b*. The top end 16*a* is formed into a loop 17 and is secured to itself by means of stitches 18 (FIG. 2). The stitches 18 are also used to secure to the strap 16 a hand grip comprising a loop 20 of similar but preferably somewhat narrower strap material that has overlapped ends at 21 adjacent the strap 16 that are secured together by the stitches 18. Extending through the loop 17 is a rope 22 or other suitable means for securing the upper end of the ladder 10–14 to a fixed object such as, in this case, the stanchions 25 of a boat 26. The ladder 10–14 can, however, be tied to any other fixed object such as a winch or cleat.

The strap 16 is preferably formed from a fibrous material, e.g., 4-inch wide strip of nylon webbing or other suitable fabric having a tensile strength of about 5,000 to 6,000 pounds per inch of width, giving the strap a nominal strength of about 20,000 pounds. The strap loop 20 is typically about one and one-half inches wide and about 12–15 inches long. The loop 20 serves as a hand opening to enable the user to steady himself, thus assisting the user in climbing onto the boat 26.

The bottom end 16*b* of the strap 16 of the different size ladders 10, 12, 14 is formed into a generally U-shaped loop by being folded back onto itself with the end portion 16*b* placed in face-to-face lapped relationship with a portion 16*c* of the strap located a predetermined distance above the lower end 16*b* to form a loop 24 having a bottom or transverse portion which serves as a step or ladder rung 24*a*. The loop 24 has two side portions 26 and 28 which are coextensive with the rung 24*a* as clearly shown in FIG. 1. The portions 16*b* and 16*c* are secured to each other in any suitable manner, e.g., by means of stitching 30.

The ladder 12 has an additional piece of strap material 32 secured above the loop 24 by means of stitching 34 to form a loop 33. The longest ladder 14 has two additional pieces of strap material 36 and 38 formed into loops 40 and 42 similar to the loop 24 and secured to the strap 16, preferably by stitching at 44 and 46. In each case the stitches 34, 44 and 46 secure the ends of the straps 32, 40, 42 to one another and to the underlying strap 16.

Each of the loops 24, 33, 40, 42 are formed by making at least one half-twist in the strap material from which the loop is formed. It was discovered that the use of a twist is important in helping the loops to stand open and to be oriented properly so as to facilitate entry of the hand or foot. By making a half-twist in the strap material, it will be noted that the opposite surfaces of the strap are brought into contact. For example, in the small size ladder 10 at the left in FIG. 1, the rear surface of the strap 16 is placed in contact with the front surface of the end portion 16*b*. This is done by giving the end portion 16*b* of the strap 16 a one-half twist with respect to the main body of the strap 16 before placing the ends of the loop in contact with one another. All of the other loops 24, 33, 40, 42 of the ladders 12 and 14 are formed in a similar manner. For some applications, the loops can be formed with a full twist if desired, in which case the same surface of the loop will be placed in contact with itself, e.g., the front surface of the loop of strap material will be placed in contact with the front surface of the same section of strap material where the stitching 30, 34, 44 or 46 is located.

The portions of each loop which are connected to each other at the top of the loop lie in lapped face-to-face relationship which defines the top of the loop. The downwardly depending, generally U-shaped intermediate bend at the bottom of the loop which forms the step or rang (designated 24*a* in the bottom loop 24) defines an opening which facilitates the entry of a hand or foot. During use as a boarding ladder as shown in FIG. 1, the loops 24, 33, 40 and 42 are usually used for the feet, and the loop 20 serves as a hand opening or handle to steady a person and thus assist her in climbing aboard the boat 26.

Figure 4:
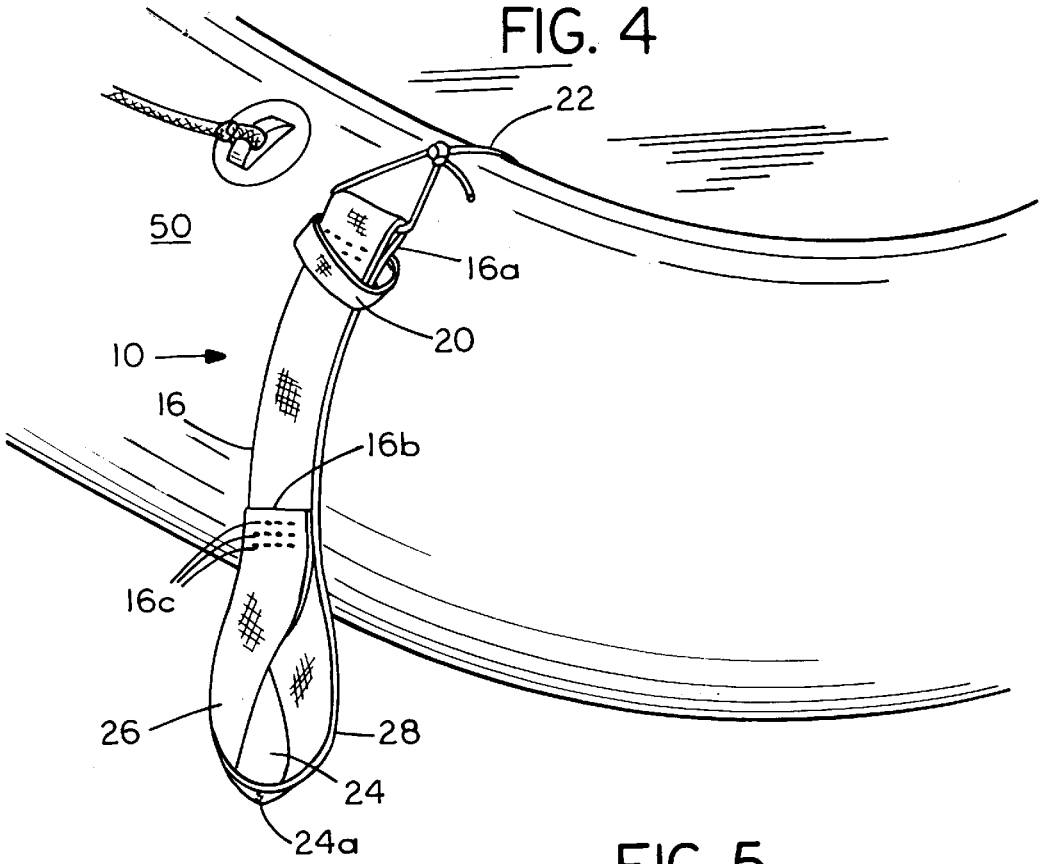
FIG. 4 is a perspective view of the invention deployed for use on a rubber dinghy.

The ladder with a single lower loop as shown at 10 in FIG. 1 is especially useful for boarding an inflatable boat 50 as shown in FIG. 4. The ladder 10 is draped over the outside surface of an inflated tube that forms the side of the inflated boat 50. A rope or other fastener 22 secures the top end 16*a* of the strap 16 to the inside of the boat 50 to hold the ladder 10 upright. The invention provides a convenient way of climbing out of the water onto any kind of watercraft by furnishing one or more soft steps that are comfortable and which cradle the feet comfortably while a person is getting back aboard the boat from the water. The ladder loops will not pinch or bind the foot during use. The bottom loop conveniently hangs below the water level for easy entry. The handle or loop 20 provides a convenient hand grip. The invention is lightweight, portable, and easy to store because it can be quickly folded into a compact bundle which is lightweight and free of rigid material. In addition, the ladder will not scratch or puncture other objects or corrode or rust. For marine applications, it can be used with any kind of boat including inflatable boats, sailboats or yachts. Boarding an inflatable or pontoon boat from the water is easily accomplished with a single step as shown at 10. The larger size units 12 or 14 are especially useful in boarding larger boats, sailboats or yachts.

Figure 5:
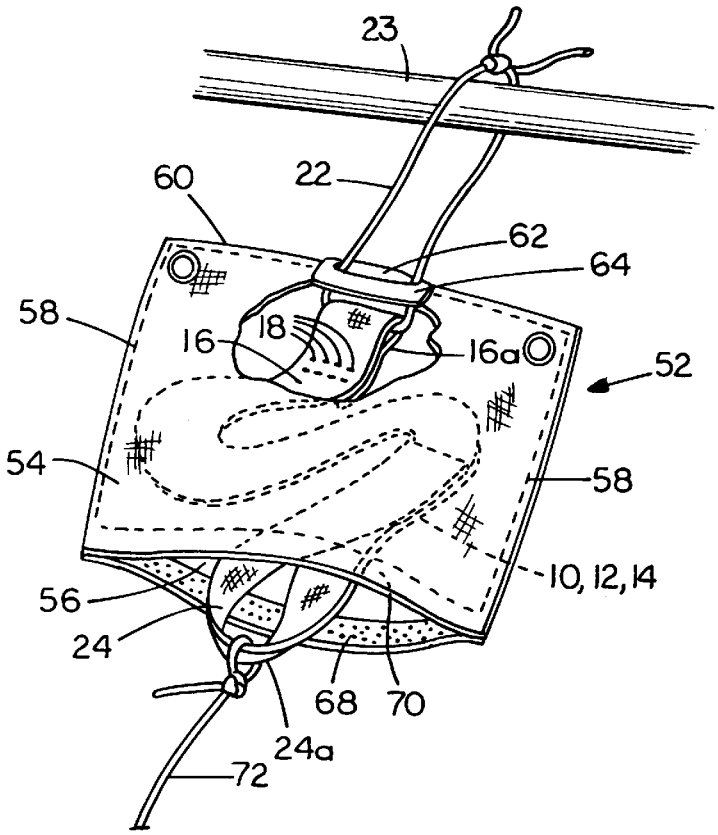
FIG. 5 is a perspective view of a storage and quick-deployment pouch in accordance with the invention.

Shown in FIGS. 1 and 5 is an optional quick deployment pouch 52. The pouch 52 can be rectangular (FIG. 1) or square as shown in FIG. 5 and consists of a pair of flexible cloth side walls 54 and 56 joined together along aligned edges by a peripheral seam 58. Any of the different sizes 10–14 of the invention is folded into a bundle and is stored in the pouch 52 with the upper end portion 16*a* of the strap 16 uppermost so that the rope 22 can extend upwardly through a slit or other opening 62 in the top edge 60, preferably surrounded by a reinforcing tape 64 that is bonded to the top edge 60 of the pouch 52 by means of adhesive or stitching or both. The rope 22 can be tied to any fixed object such as a boat railing 23. The lower edges of the side walls 54, 56 are normally held together by means of complementary hook-and-loop, e.g., Velcro® fastener strips 68, 70 which line the inside edge of the bottom of the pouch 52 and are before deployment are secured together in face-to-face connected relationship. Tied to the bottom of the bottom loop 24, i.e., the lowest step of the ladder, e.g., ladder 12, is a quick deployment cord or rip cord 72. In a typical application, the pouch 52 can be approximately 12 inches wide, 12 inches long and can be formed from nylon Cordura™ or Acrilan fabric. In FIG. 5, the ladder is shown with the bottom loop 24 partially withdrawn.

The quick deployment pouch 52 is preferably made of any suitable fabric such as nylon, cotton canvas, polyester or the like and has either a rectangular (FIG. 1) or a square (FIG. 5) shape as required to fit any size ladder 10, 12 or 14. The quick deployment pouch 52 is placed on the side of the boat with the rope 22 tied around railing 23 or other fixed object so that the rip cord 72 (which may be from 2 feet to 10 feet long) hangs into the water. If a person accidentally falls into the water or for any other reason needs the ladder, the ladder can be quickly deployed by the person in the water by pulling on the rip cord 72 which immediately withdraws the ladder from its stored location within the pouch 52, thus enabling the person in the water to climb into the boat using one of the ladders 10–14. As the ladder is withdrawn, the Velcro® strips 68, 70 separate from each other, allowing the entire ladder to be withdrawn so that the ladder is deployed in a generally upright position as shown in FIG. 1 and is then ready for use. The quick deployment pouch 52 remains in place at the top of the ladder. The quick deployment pouch 52 is particularly advantageous for emergency use because it keeps the ladder in a compact bundle that is out of the way but yet is ready for use on an instant's notice, which is especially important in case a person falls overboard.

The ladders 10–14 can be of various sizes. However, for marine use, the small size unit 10 having a single loop can have an overall length of about 37 inches; the two-step unit 12 can have an overall length of 52 inches, and a three-step unit 14 can have an overall length of 67 inches. Any number of steps can be used. To provide optimum comfort for the foot, it is preferred that the strap 16 be about 3 inches to 6 inches wide and preferably about 4 inches wide. Each loop 24, 32, 40 or 42 can have an overall height of about 15 inches from the top to the bottom of the loop.

While the invention is particularly useful in boarding boats for recreational or emergency use, it is also useful in a variety of other applications. For example, the invention can be used as a fire escape or by deer hunters to climb onto a raised platform, e.g., in a tree from which deer are spotted. Other uses will be apparent.

Many variations of the present invention within the scope of the appended claims will be apparent to those skilled in the art once the principles described herein are understood.

What is claimed is:

1. A flexible and foldable marine ladder for boarding a boat comprising, 1) a vertical supporting strap formed from flexible fabric having top and bottom ends, the top end of the supporting strap is adapted to be secured to an object on the boat for holding the ladder in an upright position over the side of the boat, 2) at least one generally upright flexible foot support comprising a loop of strap material, said loop depending from the supporting strap at a point proximate the bottom end of the supporting strap and being devoid of rigid material, said loop has two generally upright portions that are connected to each other at the top of the loop, said connected portions of the strap loop lie in lapped face-to-face relationship and said loop includes a downwardly depending generally U-shaped intermediate bend between the connected portions to provide an opening to facilitate the entry of a person's foot into the loop of strap material, 3) hand grip comprising a loop of flexible material connected to the vertical supporting strap proximate the top end thereof, the hand grip having a width that is narrower than the foot loop so as to accommodate a person's hand, and wherein the hand grip is a generally horizontally disposed loop connected to extend across said vertical supporting strap, and 4) said loop of strap material, said supporting strap and said hand grip are formed from flexible fabric devoid of rigid material to enable the boarding ladder to be folded into a bundle for storage on the boat.

2. The marine boarding ladder of claim 1 wherein the foot support comprising a loop of strap material has at least a one-half twist therein.

3. The marine boarding ladder of claim 1 wherein said boarding ladder includes a plurality of said loops of said strap material positioned one above another and connected to the vertical supporting strap to provide a multi-step ladder.

4. The marine boarding ladder of claim 1 wherein the two connected portions of the loop are positioned in alignment with each other and are aligned with the vertical supporting strap.

5. A flexible, foldable marine ladder for boarding a boat comprising, a supporting strap formed from a piece of fabric having top and bottom ends, the top end of the supporting strap is adapted to be secured to an object for holding the ladder in a depending position when deployed, the ladder includes at least one loop of strap material suspended from the supporting strap below the top end thereof, said loop of strap material is formed from a section of flexible strap material having two portions that are connected to each other at the top of the loop in lapped face-to-face relationship with a downwardly depending generally U-shaped intermediate bend in the strap material between the connected portions thereof and the U-shaped bend defines a step for a person's foot, a hand grip comprising a generally disposed loop of flexible material connected to and extending across the vertical supporting strap proximate the top end thereof, the hand grip having a width that is narrower than the loop for a person's foot so as to accommodate a person's hand, a pouch to contain the ladder, the ladder is folded into a compact bundle for storage within the pouch, the pouch includes a bottom opening for deployment of the ladder from a stored condition within the pouch, and a cord is connected to the ladder and extends from the ladder through the opening in the pouch for enabling a person to pull the folded ladder out of the pouch through the opening to a deployed, downwardly extending position ready for use.

6. The marine ladder of claim 5 wherein the bottom opening of the pouch has a pair of edges, a releasable connection is provided between the edges for holding the bottom opening of the pouch closed prior to deployment, and the pulling of the cord separates the connection between the edges of the pouch opening and allows the ladder to be withdrawn from the pouch so as to be deployed in a generally upright position.

7. The marine ladder of claim 6 wherein the connection between the edges of the pouch comprises complementary hook-and-loop fastener material affixed to the pouch adjacent the opening for normally holding the bottom opening of the pouch closed.

* * * * *